United States Patent [19]

Schoenleber et al.

[11] 4,452,399

[45] Jun. 5, 1984

[54] DOUBLE POCKET TICKET ENVELOPE

[75] Inventors: Donald Schoenleber, Princeton, N.J.; James A. Mattia, Harpers Ferry, W. Va.

[73] Assignee: Beatrice Foods Co., Chicago, Ill.

[21] Appl. No.: 502,339

[22] Filed: Jun. 8, 1983

[51] Int. Cl.[3] ..... B65D 27/08

[52] U.S. Cl. ..... 229/72

[58] Field of Search ..... 229/72, 68 R; 150/39; 281/19, 31

[56] References Cited

U.S. PATENT DOCUMENTS

| | | | |
|---|---|---|---|
| 1,677,022 | 7/1928 | Deutschmeister | 229/68 R |
| 2,228,457 | 1/1941 | Hoople | 281/31 |
| 2,828,975 | 4/1958 | Wright | 150/39 |
| 2,982,322 | 5/1961 | Seitz | 150/39 |
| 3,086,694 | 4/1963 | Tucker et al. | 229/68 R |
| 3,299,928 | 1/1967 | Inkley | 229/72 |
| 3,482,764 | 12/1969 | Aliff, Jr. et al. | 229/72 |
| 3,655,119 | 4/1972 | Thompson | 229/72 |
| 4,301,962 | 11/1981 | Monckton et al. | 229/72 |

FOREIGN PATENT DOCUMENTS

| | | | |
|---|---|---|---|
| 708332 | 6/1941 | Fed. Rep. of Germany | 150/39 |

*Primary Examiner*—Stephen P. Garbe

*Attorney, Agent, or Firm*—Shlesinger, Arkwright, Garvey & Fado

[57] ABSTRACT

A double pocket ticket envelope, comprising a first panel having a pair of side edges, a top edge, and a bottom edge; a second panel having a bottom edge secured to said first panel bottom edge and extending upwardly therefrom and overlying at least a portion of said first panel for forming a first pocket therebetween; a third panel extending from said first panel along a scoreline defining one of said pair of side edges and being folded along said scoreline for overlying at least a portion of said second panel; and, said third panel having a bottom edge secured to said second panel bottom edge for forming a second pocket between said second and third panels is disclosed.

1 Claim, 3 Drawing Figures

DOUBLE POCKET TICKET ENVELOPE

BACKGROUND OF THE INVENTION

Ticket holding individuals, particularly airline ticket ticketholders, find frequently that they must have ready access to any one of a plurality of separate tickets. Often times the ticketholder must simply display the appropriate ticket to a concerned individual. A ticket envelope completely covering all tickets requires the traveller to open the envelope and sort through the tickets to find the appropriate one, with the result of an increased expenditure of time. Airline ticketing in particular frequently requires that the ticketholder simultaneously display the ticket and an appropriate boarding pass.

Prior art ticket envelopes, of which Thompson U.S. Pat. No. 3,655,119 is an example, do not present a solution to the problem of the simultaneous display of multiple tickets. Thompson provides only a first full length pocket with a smaller second pocket formed in a panel simultaneously forming the first pocket. Thompson is not a complete solution as the second pocket is much smaller than the first pocket. Additionally, Thompsom is a rather complicated envelope and requires a particularly configured envelope blank with a resultant waste in envelope material and with the need for relatively larger amounts of glue to form the envelope.

In view of the above outlined problems, a new and unique solution to the problem of providing an envelope for displaying a plurality of tickets is needed. The disclosed invention presents such a new and unique ticket envelope which is capable of being formed from a rectangular paper blank and which is uniquely configured for simultaneously displaying a plurality of tickets.

BACKGROUND OF THE INVENTION

It is a primary object of the disclosed invention to provide a ticket envelope which substantially alleviates the problems outlined above.

It is an additional object of the disclosed invention to provide a ticket envelope which is adapted for simultaneous display of a plurality of tickets and which tickets may all be of the same size.

It is a further object of the disclosed invention to provide a ticket envelope which may be readily manufactured from a rectangular paper blank with a minimum amount of glueing.

Yet another object of the disclosed invention is to provide a ticket envelope which has printed matter thereon for readily identifying the appropriate ticket.

Still another object of the disclosed invention is to provide a mass produced ticket envelope having at least two compartments for holding a plurality of tickets.

These and other objects and advantages of the invention will be readily apparent in view of the following description and drawings of the above-identified invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
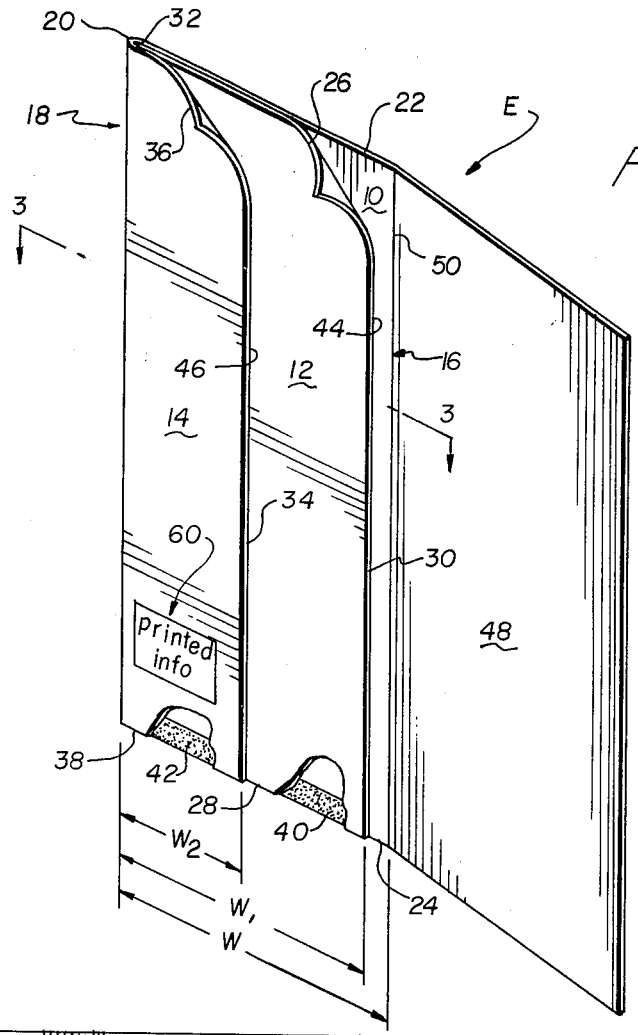
FIG. 1 is a perspective view with portions broken away of the ticket envelope of FIG. 1.
Figure 2:
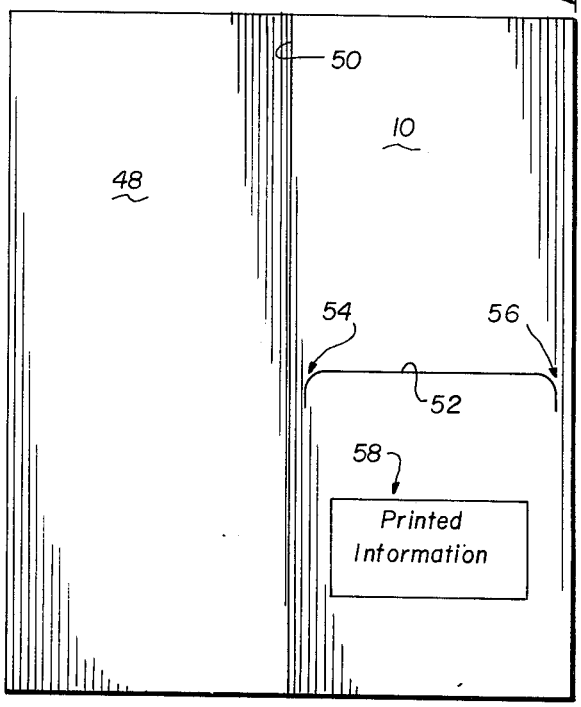
FIG. 2 is a front elevational view of the ticket envelope of FIG. 1.
Figure 3:
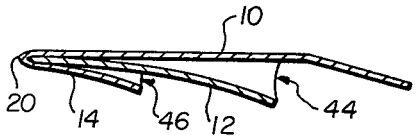
FIG. 3 is a fragmentary cross-sectional view taken along the Section 3—3 of FIG. 1 and viewed in the direction of the arrows.

A double pocket ticket envelope E, as best shown in FIG. 1, has a first planar panel 10, a second planar panel 12, and a third planar panel 14. First panel 10 has generally parallel longitudinally extending side edges 16 and 18 and, preferably, third panel 14 is integral with first panel 10 and extends from side edge 18 along a scoreline 20 defining side edge 18.

First panel 10 is generally rectangular and has an upper edge 22 and a lower edge 24 and, preferably, upper edge 22 and lower edge 24 are perpendicular to side edges 16 and 18 and parallel to each other.

Second panel 12 is generally rectangularly shaped and has an upper edge 26 and a lower parallel edge 28 with generally parallel side edges 30 and 32 generally perpendicular to upper edge 26 and lower edge 28.

Third panel 14 has a side edge 34 generally parallel to side edge 18 and an upper edge 36 and a lower edge 38. Lower edge 38 and upper edge 36 are generally pependicular to parallel side edges 18 and 34.

Second panel 12 is secured along its bottom edge 28 to bottom edge 24 by means 40 such as glue or other suitable sealing means known in the art. Second panel 12 extends upwardly and overlies a substantial portion of first panel 10.

Third panel 14 is folded along scoreline 20 and overlies at least a portion of second panel 12. The bottom edge 38 of third panel 14 is secured to the bottom edge 28 of second panel 12 by glue means 42, although other securing means are well known in the art.

Panels 10, 12 and 14 all have generally the same equal height but panels 10, 12 and 14 preferably each have a different width. First panel 10 has a width W which is greater than the width W1 of second panel 12 and the width W1 of second panel 12 substantially exceeds the width W2 of third panel 14. In this way, a ticket (not shown) placed in a first pocket 44 disposed between first panel 10 and second panel 12 may be held therein while having its outer edge portion exposed because width W exceeds width W1. Similarly, a ticket (not shown) disposed in second pocket 46 disposed between second panel 12 and third panel 14 may also have a portion thereof exposed because width W1 exceeds width W2 while still permitting access to the ticket (not shown) held in pocket 44.

A fourth panel 48 extends from first panel 10 along a scoreline 50 defining side edge 16 and is adapted for being folded along scoreline 50 for closing envelope E. Preferably, fourth panel 48 has a width at least equal to width W of first panel 10.

First panel 10 has a slit 52 which is intermediate top edge 22 and bottom 24 and which is generally transverse of side edges 16 and 18 and which, preferably, has rounded edges 54 and 56 to permit ready insertion of a planar insert into slit 52 and pocket 44 thereby. Preferably first panel 10 includes printed material 58 located adjacent slit 52 so as to be visible when a planar insert (not shown) is positioned in slit 52. Additionally, third panel 14 preferably contains printed information 60 so as to be visible when fourth panel 48 is folded outwardly exposing second and third panels 12 and 14 respectively. Printed information 58 and 60 may include advertising or ticketing information or other similar suitable material.

While this invention has been described as having a preferred design, it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

What we claim is:

1. A paper double pocket ticket envelope, comprising:

(a) a first rectangular panel including parallel top and bottom edges defining said envelope height and first and second scorelines forming parallel side edges defining said envelope width;

(b) a second rectangular panel having parallel first and second surfaces and a height equal to said first panel height and a width less than said first panel width, said second panel including a first edge abutting said first scoreline and a second edge short of said second scoreline and said second panel further including a bottom edge;

(c) glue means adhesively securing said second panel first surface bottom edge to said first panel bottom edge for providing a first pocket between first and second panel;

(d) a third rectangular panel integral with and extending from said first panel first scoreline, said third panel having a height equal to said first panel height and a width substantially half said second panel width and said third panel including a bottom edge;

(e) glue means adhesively securing said third panel along the bottom edge thereof to said second panel second surface bottom edge for providing a second pocket between said second and third panels;

(f) a fourth rectangular panel integral with and extending from said first panel second scoreline, said fourth panel having a height equal to said first panel height and width substantially equal to said first panel width whereby said fourth panel adapted for being folded over said third panel to thereby close said envelope; and, (g) a slit disposed in said first panel intermediate said top and bottom edges and having a width less than said first panel width.

* * * * *